US008819976B1

(12) United States Patent
Kellgren

(10) Patent No.: US 8,819,976 B1
(45) Date of Patent: Sep. 2, 2014

(54) TUBULAR MAGAZINE FIREARM WITH SHEET METAL RECEIVER

(75) Inventor: George Kellgren, Cocoa, FL (US)

(73) Assignee: Kel-Tec CNC Industries, Inc., Cocoa, FL (US)

( * ) Notice: Subject to any disclaimer, the term of this patent is extended or adjusted under 35 U.S.C. 154(b) by 182 days.

(21) Appl. No.: 13/292,584

(22) Filed: Nov. 9, 2011

Related U.S. Application Data

(63) Continuation-in-part of application No. 29/379,458, filed on Nov. 19, 2010, now Pat. No. Des. 665,042.

(51) Int. Cl.
*F41A 9/61* (2006.01)

(52) U.S. Cl.
USPC ..... 42/6; 42/75.03

(58) Field of Classification Search
USPC ..... 42/6, 75.03
See application file for complete search history.

(56) References Cited

U.S. PATENT DOCUMENTS

| | | | | | |
|---|---|---|---|---|---|
| 859,932 | A * | 7/1907 | Edwards | 42/96 |
| 2,096,028 | A * | 10/1937 | Burton et al. | 42/17 |
| 2,455,644 | A * | 12/1948 | Barnes | 42/75.03 |
| 3,380,182 | A * | 4/1968 | Browning | 42/75.03 |
| 3,611,608 | A * | 10/1971 | Seiberling | 42/17 |
| 3,619,928 | A * | 11/1971 | Martin et al. | 42/25 |
| 3,631,621 | A * | 1/1972 | Tito | 42/17 |
| 3,740,884 | A * | 6/1973 | Wilhelm | 42/17 |
| 3,827,171 | A * | 8/1974 | Smith | 42/69.03 |
| 3,961,436 | A * | 6/1976 | Hagen et al. | 42/75.02 |
| 4,012,859 | A * | 3/1977 | Johansson et al. | 42/75.03 |
| 4,014,247 | A * | 3/1977 | Tollinger | 89/191.02 |
| 4,027,414 | A * | 6/1977 | Felix | 42/127 |
| 4,596,084 | A * | 6/1986 | Martial | 42/75.03 |
| 5,119,575 | A * | 6/1992 | Gajdica | 42/19 |
| 5,918,401 | A * | 7/1999 | Rowlands | 42/16 |
| 6,070,354 | A * | 6/2000 | Burigana et al. | 42/71.01 |
| 6,347,569 | B1 * | 2/2002 | Butler | 89/191.01 |
| 6,564,691 | B2 * | 5/2003 | Butler | 89/191.01 |
| 7,526,887 | B2 * | 5/2009 | Engel | 42/16 |
| 7,685,755 | B1 * | 3/2010 | Bentley | 42/1.06 |
| 7,814,695 | B1 * | 10/2010 | Keeney et al. | 42/75.01 |
| 8,312,656 | B2 * | 11/2012 | Lesenfants | 42/16 |
| 8,316,569 | B1 * | 11/2012 | Chvala | 42/90 |
| 2003/0140542 | A1 * | 7/2003 | Kay | 42/75.03 |
| 2004/0226211 | A1 * | 11/2004 | Keeney et al. | 42/71.01 |
| 2010/0275486 | A1 * | 11/2010 | Lesenfants | 42/17 |
| 2012/0285065 | A1 * | 11/2012 | Chvala | 42/90 |

* cited by examiner

*Primary Examiner* — Michelle R Clement
(74) *Attorney, Agent, or Firm* — Brian S. Steinberger; Phyllis K. Wood; Law Offices of Brian S. Steinberger, P.A.

(57) ABSTRACT

A novel firearm is lightweight, compact, and the method of manufacture is easy. A single or dual tubular magazine positioned below the barrel of a firearm includes the novel use of an inverted U-shaped stamped sheet metal receiver with a cavity for housing a loading and ejection port. The present invention advances the art of firearm manufacture by disclosing a tubular magazine and stamped sheet metal receiver that encloses the major parts of a firearm. The firearm is simple to manufacture, lightweight, approximately 25 to approximately 27 inches in length, and affords an ammunition capacity that is at least twice the capacity of a comparable firearm, such as the Remington® 870 shotgun.

12 Claims, 11 Drawing Sheets

TUBULAR MAGAZINE FIREARM WITH SHEET METAL RECEIVER

This invention is a continuation-in-part of U.S. Design patent application Ser. No. 29/379,458 filed Nov. 19, 2010.

FIELD OF THE INVENTION

The present invention generally relates to a firearm commonly known as a shotgun, and more particularly, a single or dual tubular magazine firearm with a sheet metal receiver enclosing a hollow stock and attached grip.

BACKGROUND AND PRIOR ART

Shotguns first came into use in the early 1600s. The first two-barrel shotgun appeared in 1873, and the first modern, hammerless, pump-action shotgun was produced in 1904. By the turn of the $20^{th}$ century, they were immensely popular. Many military officers loved their personal shotguns so much that they brought them along instead of sidearms to World War I, earning them the nickname "trench guns." Since then, shotguns have become a permanent part of the military arsenal and a part of the everyday lives of many civilians as well.

For any firearm to do its job it must first make contact with the target and secondly hit the target in a critical spot. A shotgun provides a wider stream of potentially deadly projectiles. As long as the target is within its effective range, a shotgun will give you a much better chance of making critical contact with one pull of the trigger.

The shotgun is an indispensable tool—on the farm, in combat and on the hunt. They are just as useful in non-lethal situations, such as, for scaring away pests or for opening locked doors in a police or military situation, as they are for big game hunting.

For most firearms, including a shotgun, the basic workings include sending ammunition out of a long cylinder called a barrel, loading and unloading of new and spent ammunition. When the trigger is pulled, a hammer or firing pin strikes an explosive charge on the back of a cartridge or bullet. This causes a small explosion that changes the air pressure in the barrel, forcing whatever is in front of the explosion, such as a bullet or metal pellets, out the other side at speeds measuring several thousand feet per second (fps).

All shotguns have some of the same basic components. Starting from the end nearest to the shooter, there's often a stock that allows the user to steady it against the user's shoulder muscles. Some manufacturers put a recoil pad at the end of the stock to help dampen the kick that is felt when the gun is fired. Moving forward from the stock, all the parts associated with firing. This includes the trigger that connects the sear and hammer. Some shotguns have a pistol grip that extends downward below the trigger.

The hammer activates the bolt assembly and firing pin, which rests against the cartridge to be fired. Next is the chamber, where the loading, unloading and firing happens. The chamber can be accessible from the side or the top. Connecting the chamber is the barrel which is the long tube that the ammo travels through as it leaves the gun. Some shotguns have a magazine connected to the chamber, this may take the form of a second, shorter tube below the barrel or else a drum or rectangular cartridge that snaps into the barrel. There may also be a fore-end, usually spelled forend (a sliding handle colloquially known as a pump) attached to the shorter tube, which is used to partially automate the loading and unloading process. On top of the barrel, there is a bump or notch that is used as a crude sight.

A representative sample of known prior art includes patents and the patent publication discussed below.

U.S. Patent Publication 2008/0121096 to Hajjar et al. shows a high-capacity magazine for holding a cartridge for use with a firearm; the magazine comprises a plurality of tubes being defined within the magazine and axisymmetric about a longitudinal axis.

U.S. Pat. No. 7,380,361 to Hajjar et al. shows a magazine comprising a plurality of tubes being defined within the magazine and axisymmetric about a longitudinal axis; the magazine further includes a bias, e.g., spring, contained within the magazine for urging the cartridge toward the open end of the tube wherein the retainer, actuator, and bias cooperate to expel the cartridge from the magazine in response to movement of the trigger assembly. Mechanisms for releasing, receiving, and maneuvering ammunition into a barrel, as well as the hammer, safety, and firing mechanism, are preferably contained within a pistol-grip lower receiver and are of relatively conventional design.

U.S. Pat. No. 6,397,721 to Murello shows a feed fork that lifts the cartridge upward into a feed station where it supports the cartridge such that the longitudinal axes of the barrel and the cartridge coincide.

U.S. Pat. No. 6,389,947 to Murello discloses a tubular magazine beneath the barrel and includes a liftable and lowering device controlled by the breech movement to lift the cartridge to a feed station in which the cartridge is situated behind the barrel; a feed fork is provided which functions as lifting device.

U.S. Pat. No. 5,367,810 to Stead et al. shows magazine well comprised of tubular magazine members wherein ejection from magazine is by camming action and feed member retains the cartridge in position until the cartridge is complementally and slidably received into the barrel. A gate member is mounted at an open end of the tubular magazine members to inhibit ejection of the cartridge from the tubular member.

The state of the art describing firearms with tubular magazines and means for loading and engaging cartridges prior to 1985, is shown in the following U.S. Patents: U.S. Pat. No. 4,527,459 to Childers; U.S. Pat. No. 3,665,631 to Domian; U.S. Pat. No. 3,213,558 to Asker; U.S. Pat. No. 3,172,222 to E. S. Vartanian; U.S. Pat. No. 3,003,274 to C. H. Morse et al.; U.S. Pat. No. 2,871,603 to R. H. Wild; U.S. Pat. No. 2,765,557 to W. F. Rober; U.S. Pat. No. 2,704,491 to G. Prola et al.; U.S. Pat. No. 2,333,677 to W. C. Roemer; U.S. Pat. No. 2,271,576 to Wilcox; U.S. Pat. No. 2,094,577 to N. Brewer; U.S. Pat. No. 1,481,042 to Fritz et al.; U.S. Pat. No. 1,343,444 to G. M. Formby.

The patents and patent publication listed above disclose the variations around the use of tubular magazines on firearms, but do not disclose an easy to manufacture, light weight firearm with a stamped sheet metal receiver, and an inverted U-shaped sheet metal profile covering the hollow stock that is open at the bottom for loading cartridges and ejection of spent cases. The simplicity of the design the firearm satisfies the need for a reliable weapon of the shotgun variety that is low cost, light weight and smaller in size than traditional shotguns.

SUMMARY OF THE INVENTION

The disclosed invention, which shall be subsequently described in greater detail, provides a new design for a firearm in the shotgun family. The new and novel features include, but are not limited to, the design of a hollow stock, an efficient arrangement of a an inverted U-shaped sheet metal profile open at the bottom for loading cartridges and ejection of spent cases that attaches one or two tubular magazines and receives a barrel extension that is inserted above the tubular magazine(s). The design and function of the firearm of the present invention has not been suggested, anticipated or rendered obvious by any of the prior art references.

The first objective of the present invention is to provide dual tubular magazine and receiver that is simple to manufacture and lightweight.

The second objective of the present invention is to provide a single or dual tubular magazine for a shotgun with a removable barrel inserted above the magazine.

The third objective of the present invention is to provide a grip housing the firing mechanism attached to the bottom of the receiver.

The fourth objective of the present invention is to provide a dual tubular magazine and receiver for a shotgun that has an overall length of approximately 25 inches to approximately 27 inches.

A firearm in the present invention consists of a stock, a grip, an assembly of at least one tubular magazine for ammunition positioned below a barrel with a barrel extension at the rear of the barrel, and an inverted U-shaped sheet metal receiver with an inside cavity for a loading and ejection port wherein the inverted U-shaped sheet metal receiver partially encloses, fastens and securely holds the stock, the grip and the assembly of magazine and barrel with barrel extension thereby forming an assembled rear end of the firearm.

It is preferred that the firearm have a the stock that includes a U-shaped lifter that rotates on an axis to lift a shell into a position to be fed into a chamber of a firearm and aid in expelling a spent shell from the chamber.

It is also preferred that the firearm have a grip that includes a trigger and a loading and ejection port. In addition, the firearm assembly includes a first tubular magazine and a second tubular magazine positioned below the barrel with the barrel extension at the rear of the barrel.

The firearm of the present invention includes a barrel with a sight base for mounting a picatinny rail, an inverted U-shaped sheet metal receiver with an attached trunnion for rigidity and the inverted U-shaped sheet metal receiver is fastened over the stock, the grip and the assembly of magazine and barrel with barrel extension by welding.

In the present invention, the inverted U-shaped sheet metal receiver is integrally formed with a left front rectangular shaped tab and an opposing and matching right front rectangular shaped tab for attaching the trunnion. Further, the inverted U-shaped sheet metal receiver is integrally formed with a left rear triangular shaped tab and an opposing and matching right rear triangular-shaped tab for attaching the stock and the rear end of the grip.

The overall length of the firearm of the present invention is between approximately 25 inches and approximately 27 inches.

A preferred method for manufacturing the firearm with an inverted U-shaped sheet metal receiver includes forming a stock having a rigid U-shaped lifter that rotates on an axis to lift a shell into a position to be fed into a chamber of a firearm and aid in expelling a spent shell from the chamber.

Next, the stock is attached to a grip that includes a trigger and a loading and ejection port with a first frame pin and a second frame pin that allows positioning at least one tubular magazine for ammunition below a barrel with a barrel extension at the rear of the barrel.

At the front end of the tubular magazine and the barrel is a muzzle plate that encloses the barrel and tubular magazine to which a forend can be attached for manual pump action.

At the rear end of the fiream, welding is used to attach an inverted U-shaped sheet metal receiver over the rear end of the tubular magazine, enclosing the barrel extension and the stock with the attached grip to form a tubular firearm with sheet metal receiver.

The method for manufacturing the firearm includes positioning at least one tubular magazine which includes a first tubular magazine and a second tubular magazine positioned below the barrel with the barrel extension at the rear of the barrel; the barrel has a sight base for mounting a picatinny rail.

The preferred method for manufacturing the firearm includes adding a trunnion to the bottom side of an inverted U-shaped sheet metal receiver for rigidity. The inverted U-shaped sheet metal receiver is integrally formed with a left front rectangular shaped tab and an opposing and matching right front rectangular shaped tab for attaching the trunnion, front end of the grip and the receiver with the first frame pin.

The inverted U-shaped sheet metal receiver is integrally formed with a left rear triangular shaped tab and an opposing and matching right rear triangular-shaped tab for attaching the rear end of the grip, receiver and stock with the second frame pin.

The preferred method of manufacturing the firearm with an inverted U-shaped sheet metal receiver provides a weapon with an overall length between approximately 25 inches and approximately 27 inches with increased ammunition capacity.

Further objects and advantages of this invention will be apparent from the following detailed description of a presently preferred embodiment, which is illustrated in the accompanying flow chart and drawings.

BRIEF DESCRIPTION OF THE FIGURES

Referring particularly to the drawings for the purposes of illustration only, and not limitation.

DESCRIPTION OF THE PREFERRED EMBODIMENT

Figure 1:
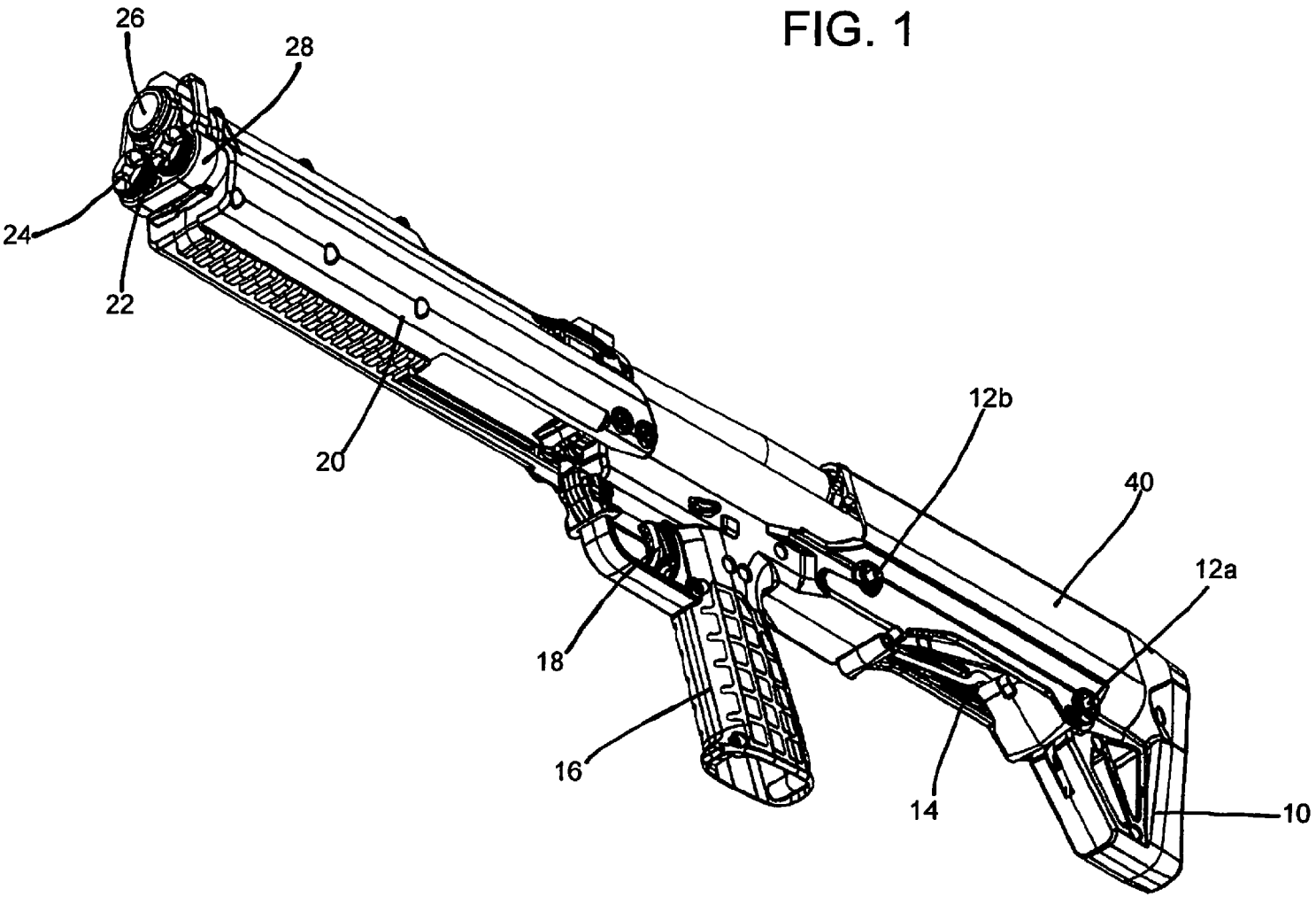
FIG. 1 is a perspective view of a fully assembled firearm of the present invention with an inverted U-shaped sheet metal receiver enclosing a hollow stock and attached grip.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

It would be useful to discuss the meanings of some words used herein and their application before discussing the dual tubular firearm of the present invention with an inverted U-shaped sheet metal receiver enclosing a hollow stock and attached grip and method of using the same.

"Ammunition," "cartridge" and "shell" are used interchangeably to mean a cylindrical, usually metal casing containing the primer and powder charge or bullet for a firearm.

"Firearm" is used herein to refer to all weapons to which a tubular magazine, barrel and stock can be enclosed in an inverted U-shaped sheet metal receiver. A preferred weapon for attaching the present invention is a shotgun.

The directional terms "horizontal," "vertical," "front," "forward," "rear," "rearward," "right," and "left" refer to the firearm when held in the normal firing position. When firing, the rear end of the firearm is close to or in close proximity to the body of the user, while the front end is farthest from the user and the point at which the ammunition exits the firearm.

"KSG" is used herein to refer to Kel-tech Shot Gun, a firearm of the present invention.

"Kevlar" is a registered trademark of the DuPont Company for a para-aramid synthetic fiber.

The "picatinny rail" is a bracket used on some firearms in order to provide a standardized mounting platform. Its name comes from the Picatinny Arsenal in New Jersey, USA where it was originally tested.

"Remington" Model 870 is a U.S.-made pump-action shotgun manufactured by Remington Arms Company, Inc. Remington® is a registered trademark of RA Brands LLC.

"Tubular magazine" is used herein to include any gauge or size of ammunition and is not limited to any particular gauge of ammunition.

Listed below are the components of the dual tubular firearm with an inverted U-shaped sheet metal receiver shown in FIGS. 1-11.

10 Stock, sometimes referred to as "hollow stock" because it houses moving parts.
12*a* Captor spring is used to form the assembly push pin.
12*b* Frame pin receives the captor spring as one of the assembly pins holding the firearm together.
14 Loading and Ejection Port
15 Lifter, a rigid U shaped steel part that rotates on an axis to lift shells into a position to be fed into the chamber and aid in expelling the spent shell from the chamber.
15*a* A right arm of the Lifter
15*b* A left arm of the Lifter
16 Grip
18 Trigger
20 Forend provides pump action
22 A first tubular magazine
24 A second tubular magazine
26 Barrel of firearm
28 Muzzle plate joins the barrel, magazine tubes and Picatinny rail together as a unit and also provides two sling attachment points.
29 Sight base, provides the mounting point for the Picatinny rail to hold sights and other accessories for the firearm.
30 Barrel extension of firearm is threaded onto the rear of the barrel.
40 Inverted U-shaped sheet metal receiver
45 Inside cavity of U-shaped sheet metal receiver that houses the loading and ejection port
50 Rectangular shaped left front tab on inverted U-shaped sheet metal receiver
51 Hole in left front tab for a frame pin to ride through
52 Notch in left front tab to provide clearance for the selector catch axis which secures the selector catch, so when the trunnion is welded to the receiver, the selector catch axis can still be inserted and removed.
53 Rectangular shaped right front tab on inverted U-shaped sheet metal receiver
54 Hole in right front tab for a frame pin to ride through
55 Notch in right front tab to provide clearance for the selector catch axis which secures the selector catch, so when the trunnion is welded to the receiver, the selector catch axis can still be inserted and removed.
60 Triangular shaped left rear tab on inverted U-shaped sheet metal receiver
61 Hole in left rear tab for a frame pin to ride through
62 Triangular shaped right rear tab on inverted U-shaped sheet metal receiver
63 Hole in right rear tab on inverted U-shaped sheet metal receiver
65 Position for spot welding the inverted U-shaped sheet metal receiver to the firearm parts housed within the inside cavity
70 Trunnion
71 Left side of trunnion
72 Left hole aligns with notches 52 and 55 to provide clearance for the selector catch axis which secures the selector catch
73 Left hole aligns with holes 51 and 54 for a frame pin to ride through
74 Left hole is for a dowel pin to be inserted which secures the cartridge stops
75 Right side of trunnion
76 Right hole aligns with notches 52 and 55 to provide clearance for the selector catch axis which secures the selector catch
77 Right hole aligns with holes 51 and 54 for a frame pin to ride through
78 Right hole is for a dowel pin to be inserted which secures the cartridge stops
79 Cross piece attaching left side to right side of trunnion In general, the operation of the tubular firearm with an inverted U-shaped sheet metal receiver of the present invention includes the use of a tubular magazine, preferably, dual tubular magazines, barrel with barrel extension threaded onto the rear of the barrel, stock with lifter, wherein the lifter is a rigid U-shaped steel part that rotates on an axis to "lift" shells into position to be fed into the firing chamber. On the downward rotation, the lifter also serves as the ejector, which aids in expelling the spent shell from the chamber.

The inventive feature of the present invention consists of providing an inverted U-shaped stamped sheet metal receiver enclosing a hollow stock and attached grip. The inverted U-shaped sheet metal receiver affords the advantages of producing a firearm that is easy to manufacture, of lower weight, and smaller size with an increased ammunition capacity. For example, Table I below compares the firearm of the present invention, identified by the acronym KSG, with a comparable firearm, the Remington® 870.

TABLE I

Size and Weight Comparison of Firearms

| Specification | KSG | Remington ® 870 |
|---|---|---|
| Barrel length | 18.5 inches | 18 inches |
| Overall length | 26.1 inches | 38.5 inches |
| Chamber | 3 inches | 3 inches |
| Magazine capacity | 6 + 6 + 1 (shells) | 4 +1 (shells) |
| Total weight | 6.9 pounds | 7.25 pounds |

The firearm of the present invention has a smaller footprint, is lighter in weight and can carry more than twice the amount of ammunition, 13 shells for KSG versus 5 shells for the Remington® 870.

Referring now to the Figures, although FIGS. 1-7 herein are drawn to show a dual tubular magazine, a single or dual tubular magazine is contemplated and considered within the scope of the present invention.

FIG. 1 is a perspective view of a fully assembled firearm of the present invention. FIG. 1 shows the major units of the firearm secured and held in place by an inverted U-shaped stamped sheet metal receiver 40. The assembled parts shown are the stock 10 with a lifter 15 having a right arm 15*a* and a left arm 15*b* (not shown in FIG. 1). Also shown is grip 16 with loading and ejection port 14 and trigger 18, positioned below and adjacent to the stock 10.

In addition, the major parts include a first tubular magazine 22, a second tubular magazine 24, and a barrel extension 30 (shown in FIGS. 5 and 9) threaded on the rear of the barrel 26. All of the major parts are enclosed and partially covered by an inverted U-shaped sheet metal receiver 40 that fastens and holds the assembled parts in place with strategic spot welding, a captor spring 12*a* that forms an assembly push pin that is inserted into a frame pin 12*b* thereby securing the assembled parts at the rear end of the firearm in a stable manner.

At the front end of the gun, the barrel 26, first tubular magazine 22 and second tubular magazine 24 are secured and held in place with a muzzle plate 28. A forend 20 is movably attached to provide the pumping action required for firing the firearm.

Figure 2:
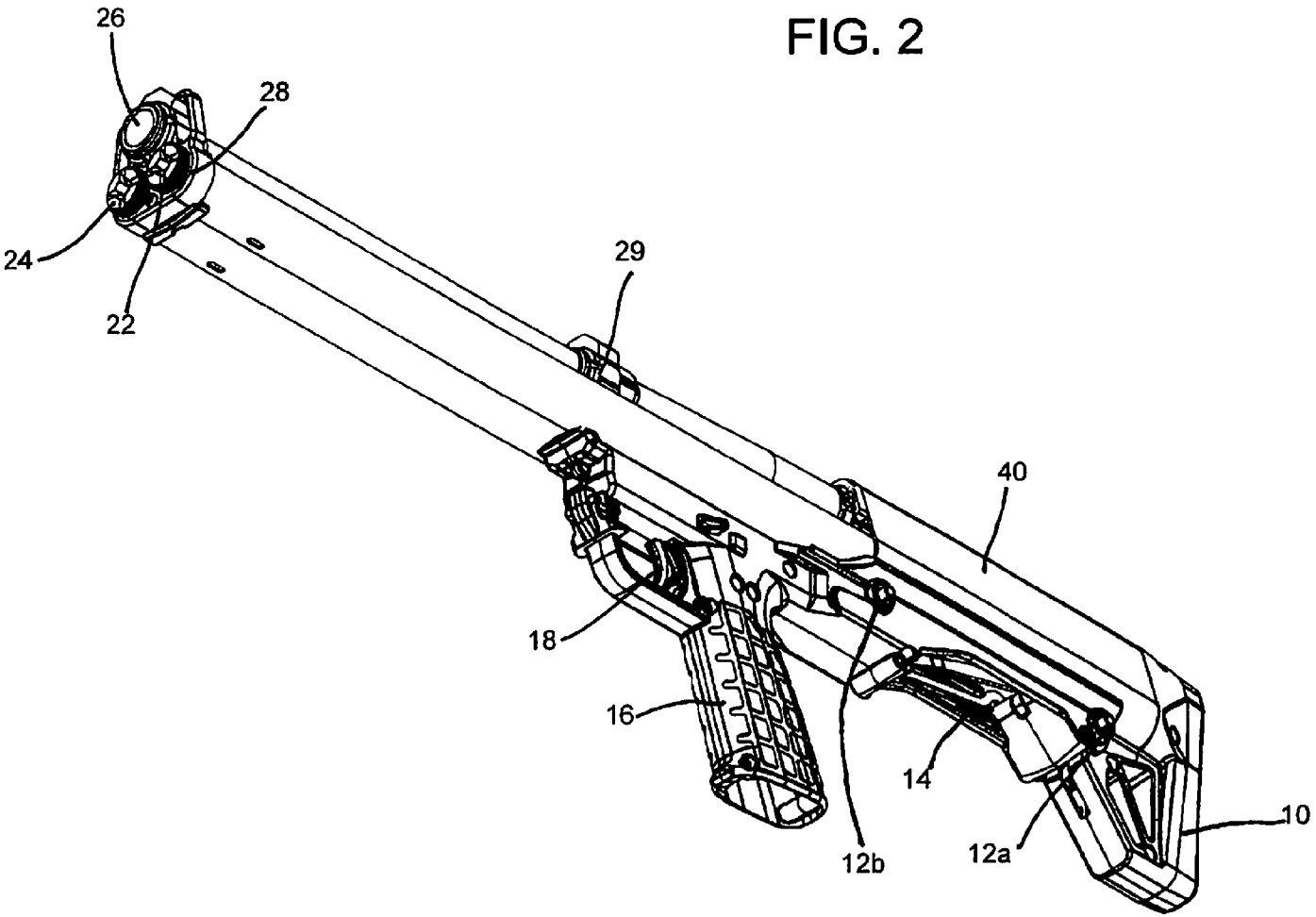
FIG. 2 is a perspective view of the firearm of the present invention with the forend removed.

FIG. 2 is a perspective view of the firearm with the forend 20 removed, thus showing how the first tubular magazine 22, second tubular magazine 24 and barrel 26 are secured and held in place with a muzzle plate 28. Also shown in FIG. 2 is the sight base 29 that provides a mounting point for the Picatinny rail.

Figure 3:
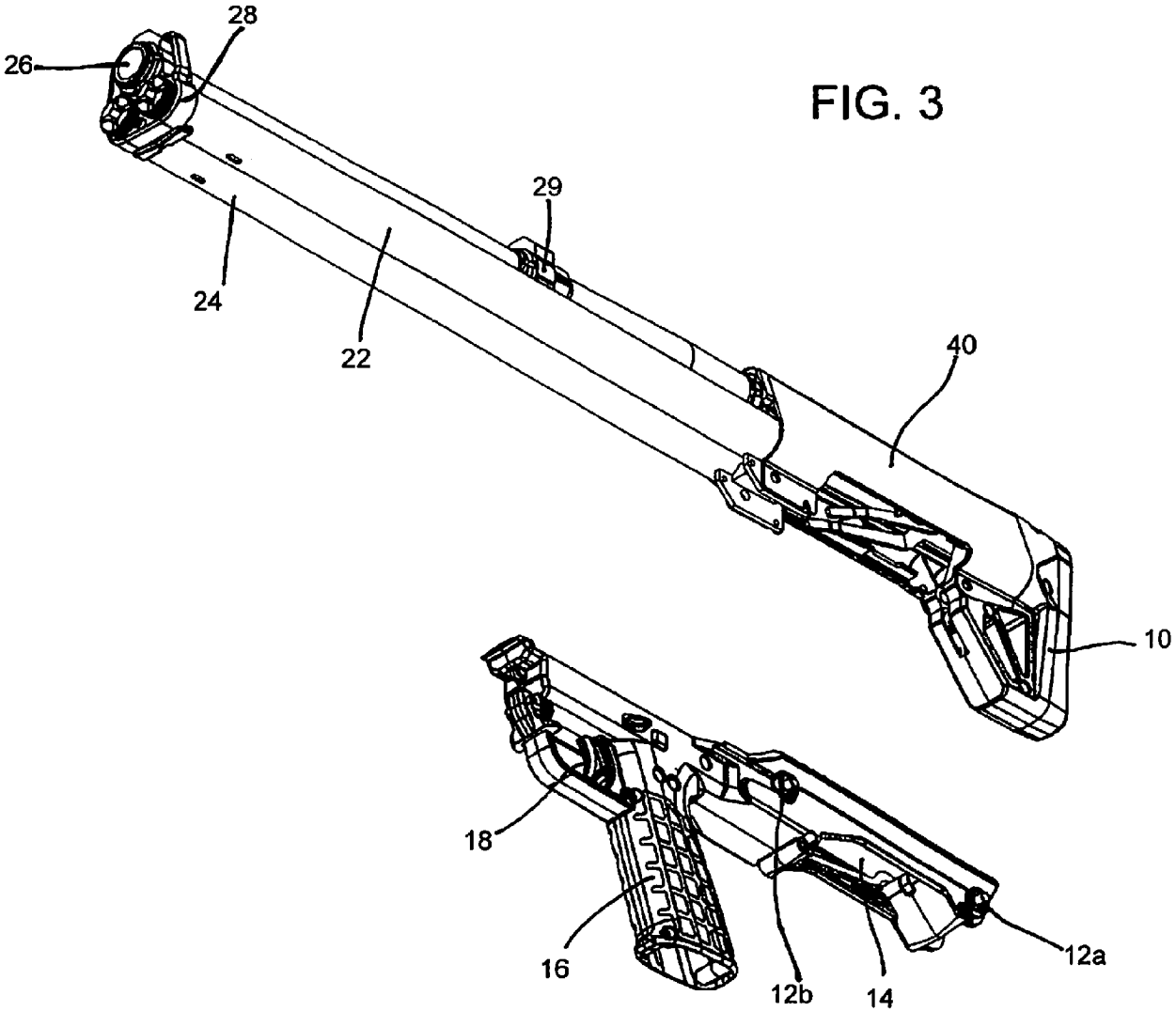
FIG. 3 is an exploded perspective view of the firearm receiver portion separated from the grip portion thereof.

FIG. 3 is an exploded view of the firearm receiver portion with stock 10, the first tubular magazine 22, second tubular magazine 24 and barrel 26 are secured and held in place with a muzzle plate 28 at the front end of the firearm and partially covered by the inverted U-shaped sheet metal receiver 40 at the rear end of the firearm. In FIG. 3, the grip portion including captor spring 12*a* that forms an assembly push pin that is inserted into a frame pin 12*b*, loading and ejection port 14, grip 16 and trigger 18, are shown apart from the receiver portion.

Figure 4:
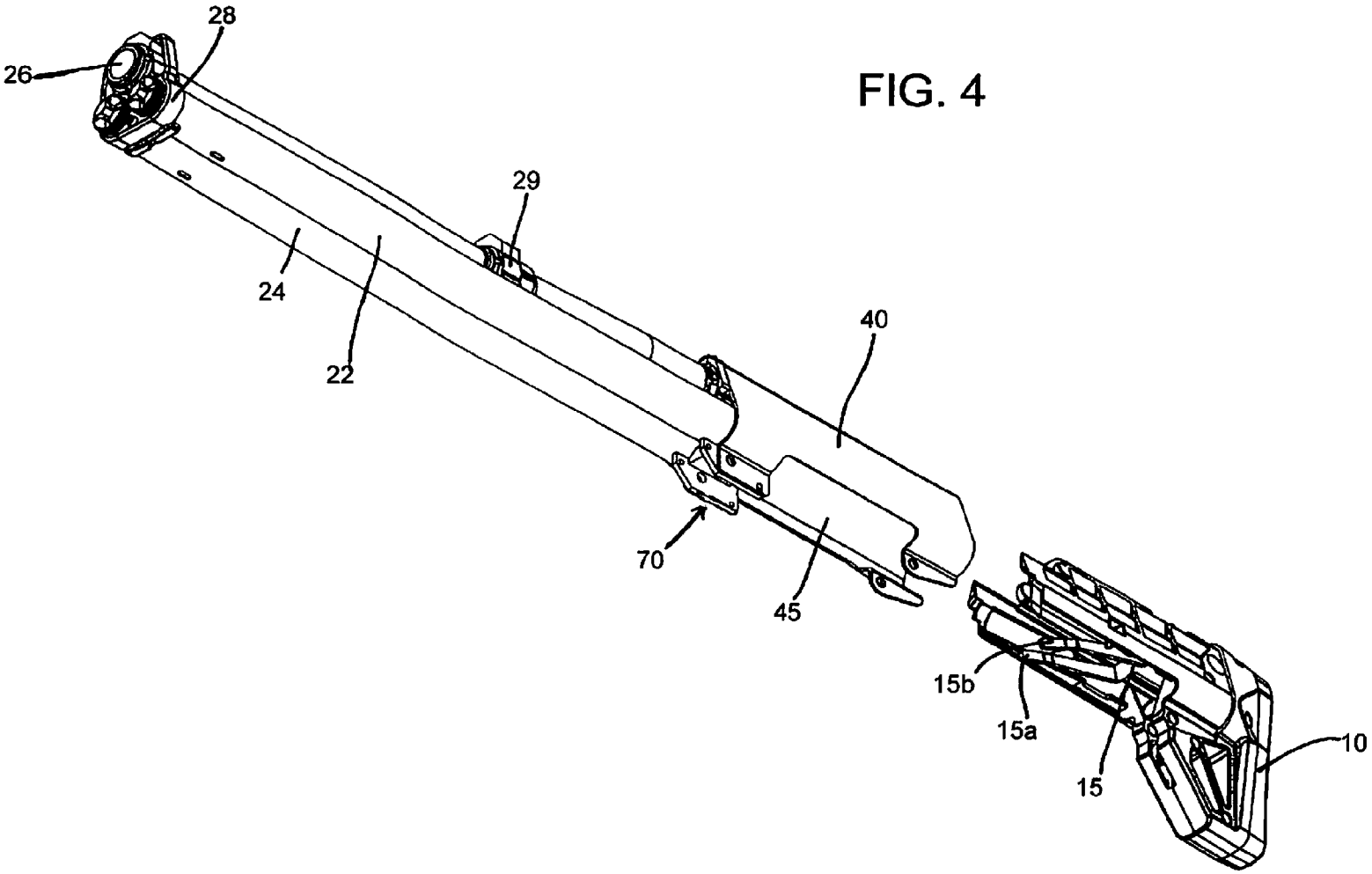
FIG. 4 is an exploded perspective view of the hollow stock of the firearm separated from the receiver portion enclosing dual tubular magazines and gun barrel.

FIG. 4 is an exploded perspective view of the stock 10 with lifter 15 having a right arm 15*a* and a left arm 15*b* separated from the inverted U-shaped sheet metal receiver 40 that encloses or partially covers a first tubular magazine 22, a second tubular magazine 24, and a barrel extension 30 (shown in FIGS. 5 and 9) threaded on the rear of the barrel 26. At the front end of the assembly, the barrel 26, first tubular magazine 22 and second tubular magazine 24 are secured and held in place with a muzzle plate 28. Also shown in FIG. 4 is the sight base 29 that provides a mounting point for the Picatinny rail.

Figure 5:
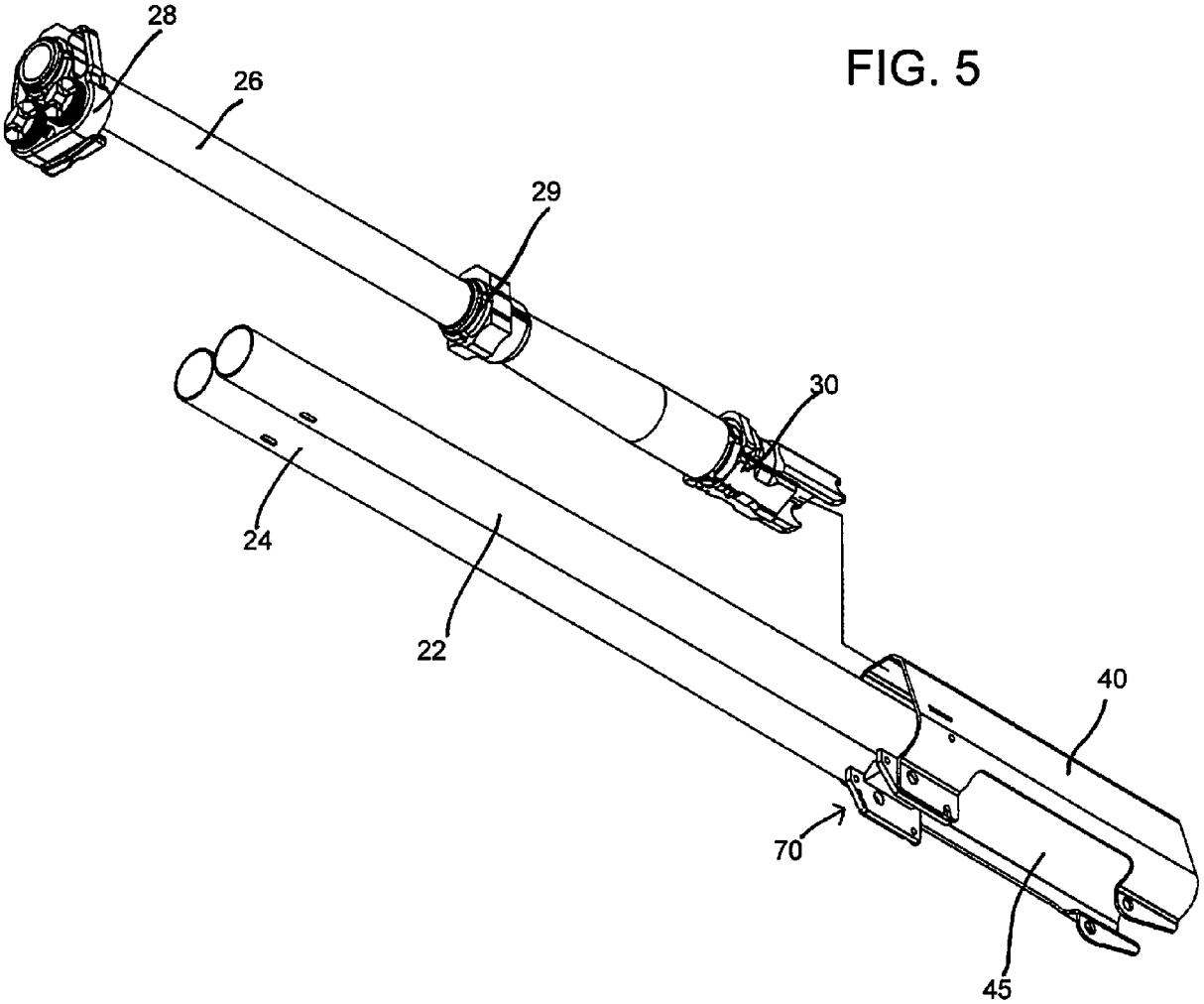
FIG. 5 is an exploded view of the fun barrel separated from the dual tubular magazines enclosed by an inverted U-shaped sheet metal receiver.

FIG. 5 is an exploded view of the muzzle plate 28 on the front of barrel 26 which has a sight base 29, and barrel extension 30 threaded onto the base of the barrel 26. The barrel assembly is separated from a first tubular magazine 22, a second tubular magazine 24 that are partially covered by the inverted U-shaped sheet metal receiver 40 with a loading and ejection port 14 cavity.

Figure 6:
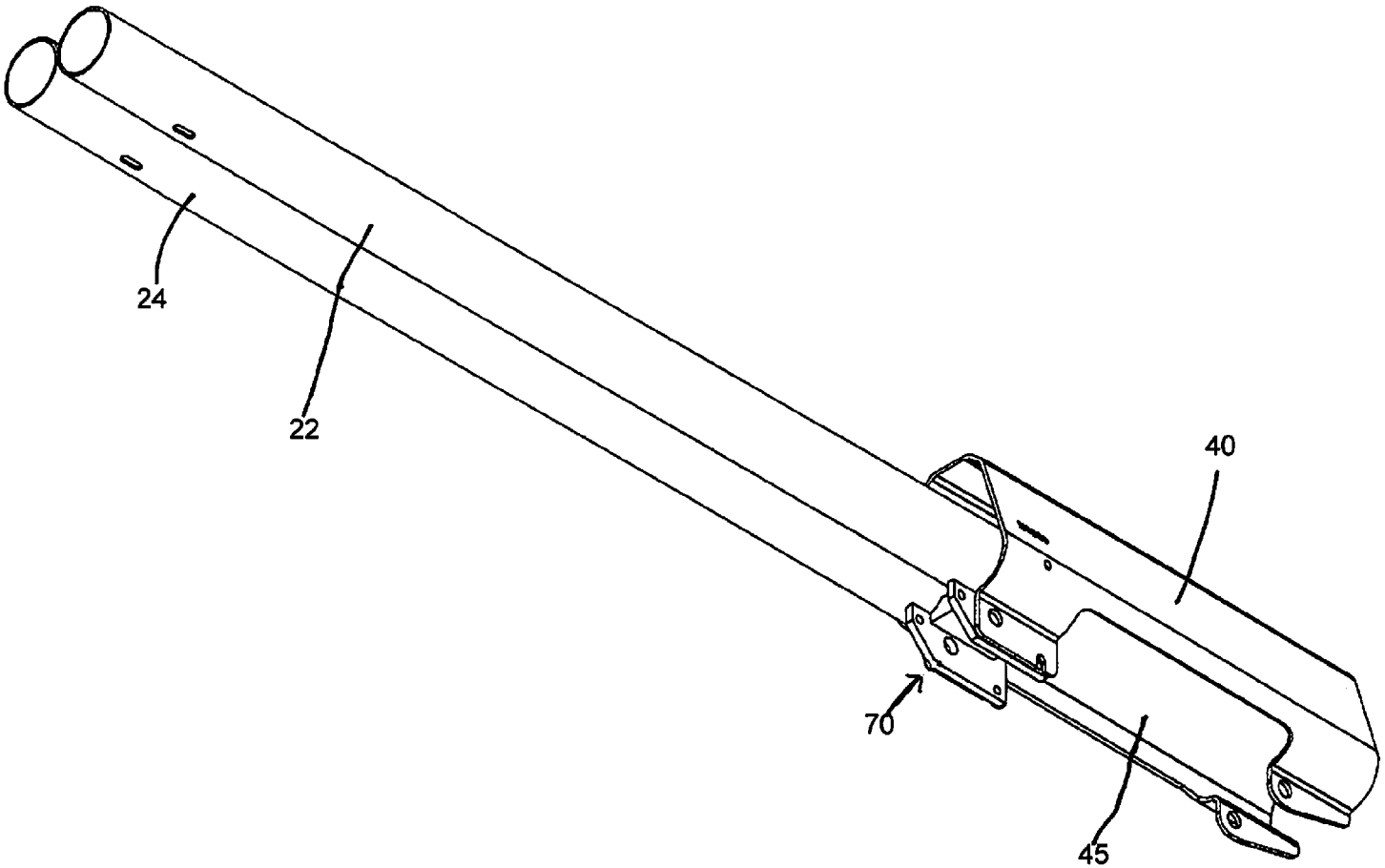
FIG. 6 is an enlarged perspective view of the dual tubular magazines enclosed by an inverted U-shaped sheet metal receiver.

FIG. 6 is an enlarged perspective view of the dual tubular magazines 22, 24 partially enclosed or partially covered by the inverted U-shaped sheet metal receiver 40 with a loading and ejection port 14 cavity.

Figure 7:
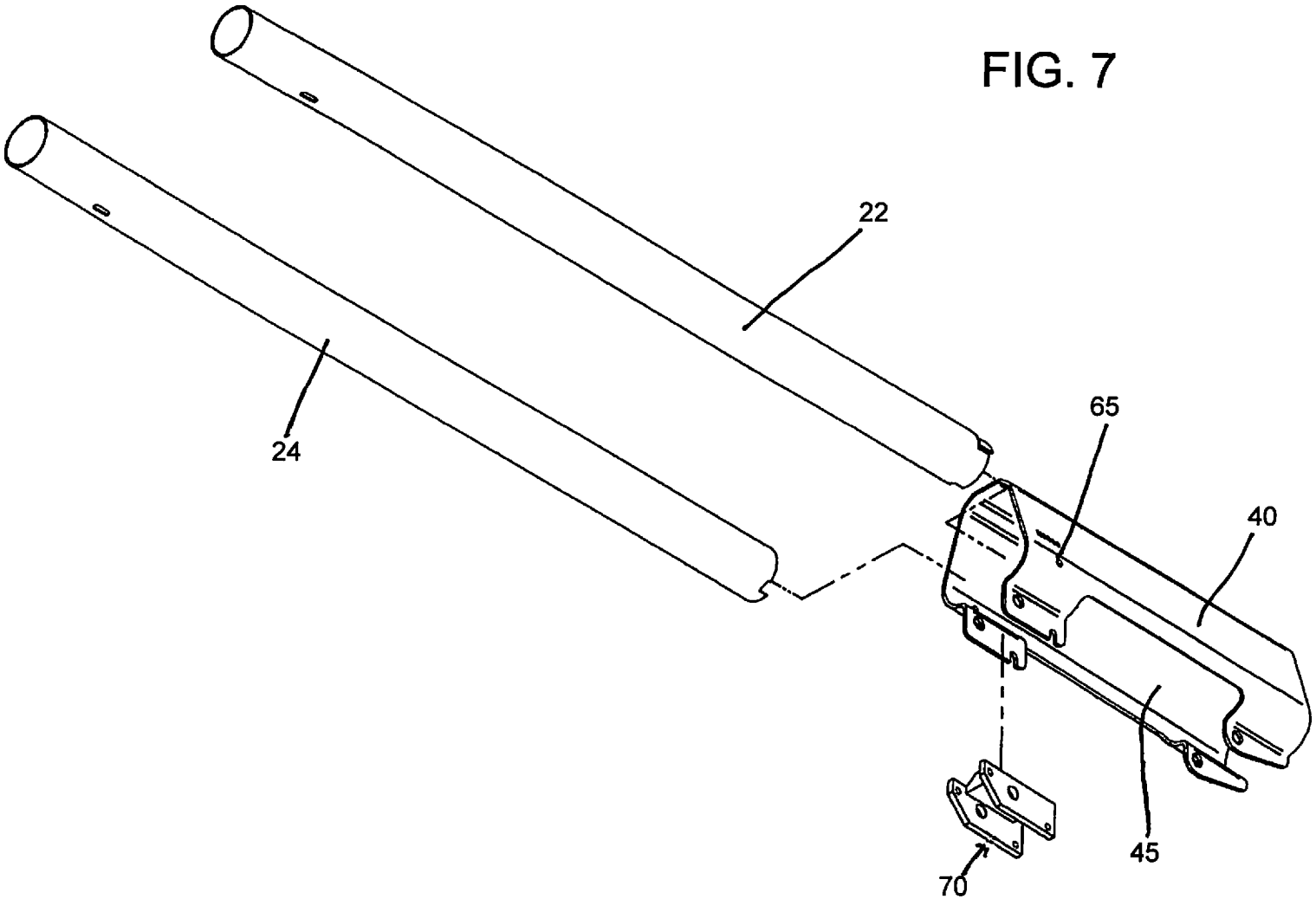
FIG. 7 is an enlarged exploded view of dual tubular magazines separated from the inverted U-shaped sheet metal receiver and a trunion.

FIG. 7 is an enlarged exploded view of the dual tubular magazines removed from the inverted U-shaped sheet metal receiver 40 with a loading and ejection port 14 cavity. Also shown in FIG. 7 is a trunnion 70 that is optionally welded below the magazines for added rigidity.

Figure 8:
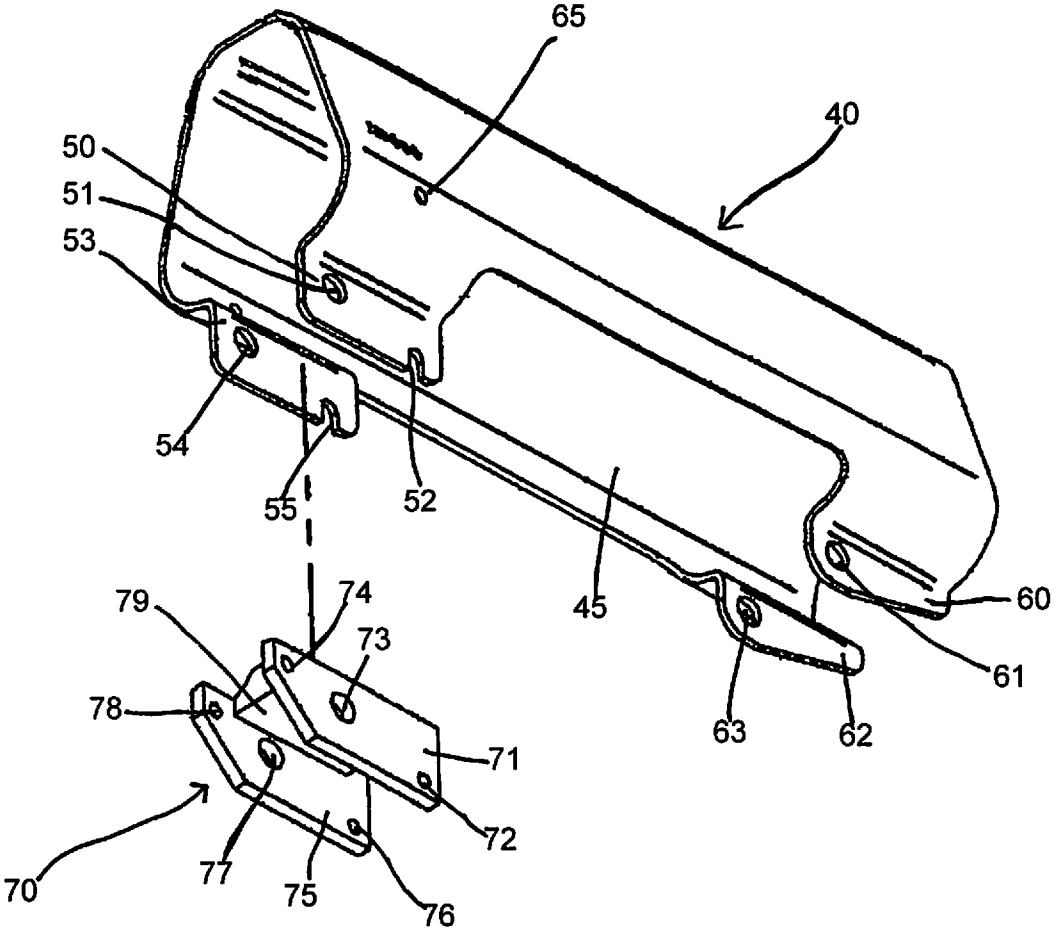
FIG. 8 is an enlarged exploded view of the inverted U-shaped sheet metal receiver separated from the stabilizing trunnion

FIG. 8 is an enlarged exploded view of the inverted U-shaped sheet metal receiver 40 separated from the stabilizing trunnion 70. In FIG. 8, the holes and notches in the tabs 50, 53, 60 and 62 at the bottom of the inverted U-shaped sheet metal receiver provide clearance for pins to be inserted. More specifically, in rectangular-shaped tabs 50 and 53, holes 51 and 54 align for a first frame pin to be inserted. Likewise, in triangular-shaped tabs 60 and 62, holes 61 and 63 are for a second frame pin to be inserted. There are two frame pins in the firearm used for rapid disassembly of the major components of the firearm.

Notches 52 and 55 in rectangular-shaped tabs 50 and 53 align for the selector catch axis to be inserted which secures the selector catch. When the trunnion 70 is welded to the receiver the selector catch axis can still be inserted and/or removed.

The inverted U-shaped sheet metal receiver 40 is designed as a one-piece unit constructed of sheet metal. The metal used is selected from all steels, including, but not limited to, stainless steel, high strength aluminum, i.e., aluminum with a Young's modulus of approximately 70 GPa, or $10\times10^6$ psi; a high strength plastic, i.e., a plastic having an ultimate tensile strength of at least 110 MPa; Kevlar®, a para-aramid synthetic fiber; carbon fiber composites or a combination thereof. For example, the material of construction can include plastic molding over a steel insert.

The inverted U-shaped stamped sheet metal receiver 40 has an inside cavity 45 that receives and houses the loading and ejection port 14 and moving parts including the lifter 15 that is an integral part of the stock 10 that fits inside the cavity 45 and forms the rear end of the firearm.

At the base of the inverted U-shaped stamped sheet metal receiver 40 on the front end are left and right rectangular shaped tabs 50 and 53 stamped with holes 51 and 54 respectively for attaching the grip to the receiver via a frame pin. The rectangular shaped tabs 50 and 53 also include notches 52 and 55 respectively that are used to provide clearance for the selector catch axis which holds the selector catch, and when the trunnion is welded to the receiver, the selector catch axis can still be inserted or removed.

At the rear end of the base of the inverted U-shaped stamped sheet metal receiver 40 are left and right triangular shaped tabs 60 and 62, respectively, stamped with holes 61 and 63. The left and right triangular shaped tabs 60 and 62 are used to provide support to holes 61 and 63 which fasten the rear end of the grip stock and receiver together via a second frame pin.

In FIG. 8, the trunnion 70 that fits between the left and right rectangular tabs 50 and 53 is shown in greater detail. The trunnion is machined to have a left side 71 with three holes, 72, 73, 74 and a right side 75 with three holes 76, 77, 78 wherein the left side 71 and right side 75 are attached with a perpendicular cross piece 79 thereby forming a stabilizing structure that fits below the tubular magazine.

When properly aligned between the rectangular tabs 50 and 53, the three holes in each of the left and right sides of the trunnion function as follows. Holes 72 and 76 align with notches 52 and 55, respectively to provide clearance for the selector catch axis which secures the selector catch. Holes 73 and 77 align with holes 51 and 54, respectively for a first frame pin to ride through attaching the front end of the grip stock and receiver together. Holes 74 and 78 are in a forward position beyond the tabs 50 and 53 for a dowel pin to be inserted which secures the cartridge stops.

Figure 9:
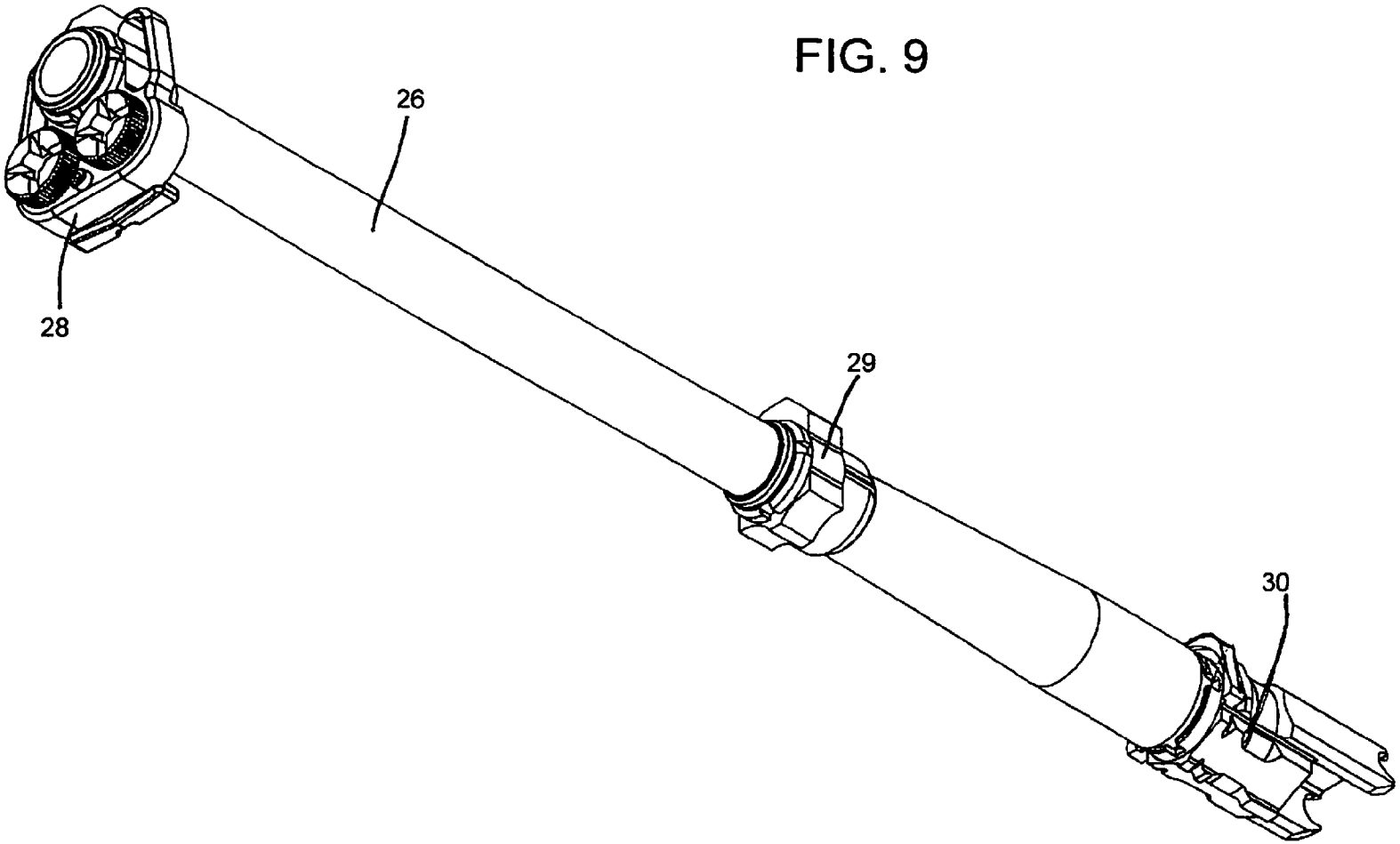
FIG. 9 is an enlarged perspective view of the barrel of the fiream of the present invention with a barrel extension, sight base for mounting the Picatinny Rail, and muzzle plate at the forward end.

FIG. 9 is an enlarged perspective view of the barrel of the firearm of the present invention with muzzle plate 28 on the front end of barrel 26, sight base 29 and barrel extension 30 threaded at the rear end of barrel 26.

Figure 10:
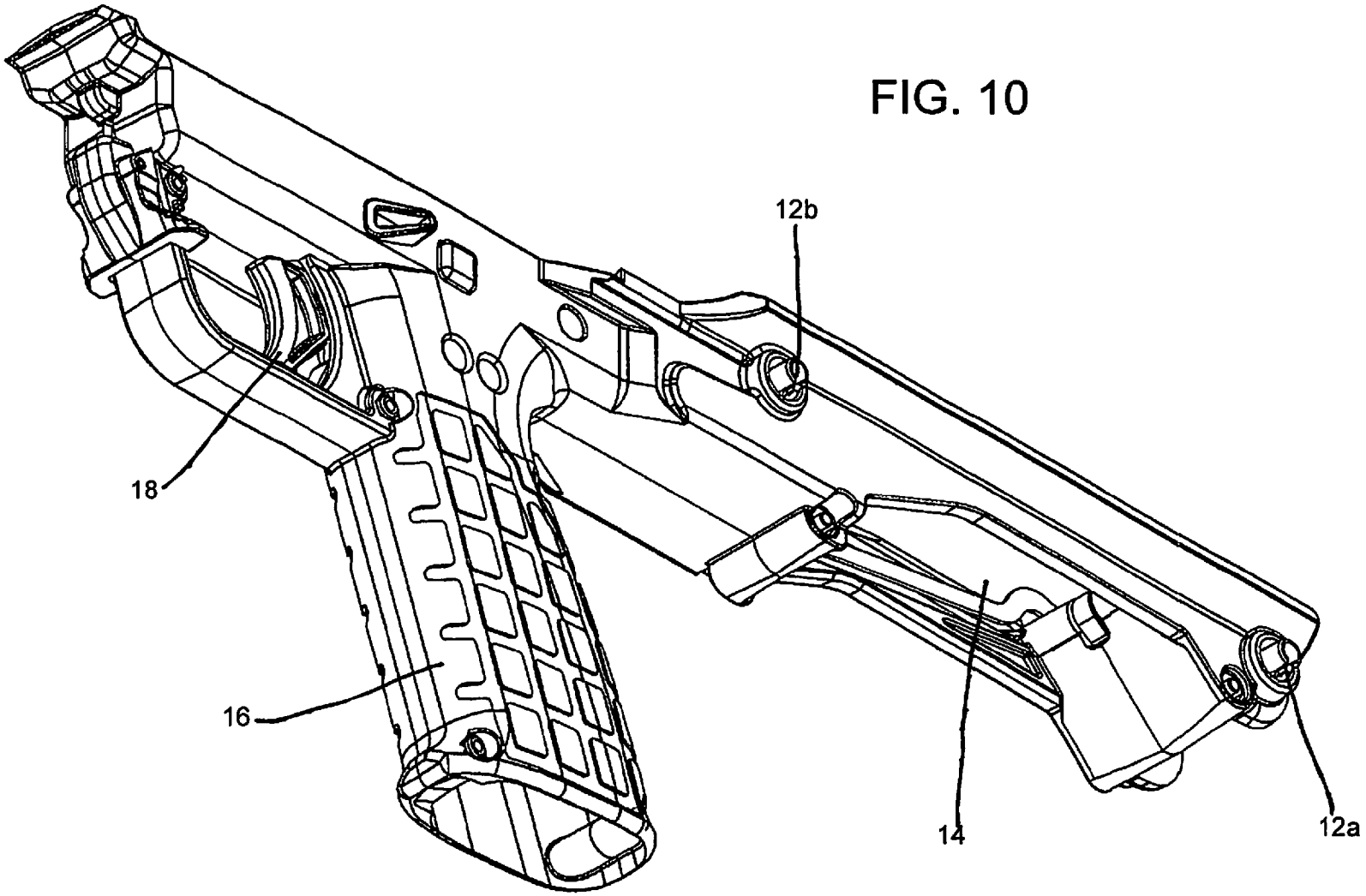
FIG. 10 is an enlarged perspective view of the grip with a loading and ejection port and a trigger.

FIG. 10 is an enlarged perspective view of the pistol grip of the present invention consisting of captor spring 12*a* that forms an assembly push pin that is inserted into a frame pin 12*b*, loading and ejection port 14, grip 16 and trigger 18.

Figure 11:
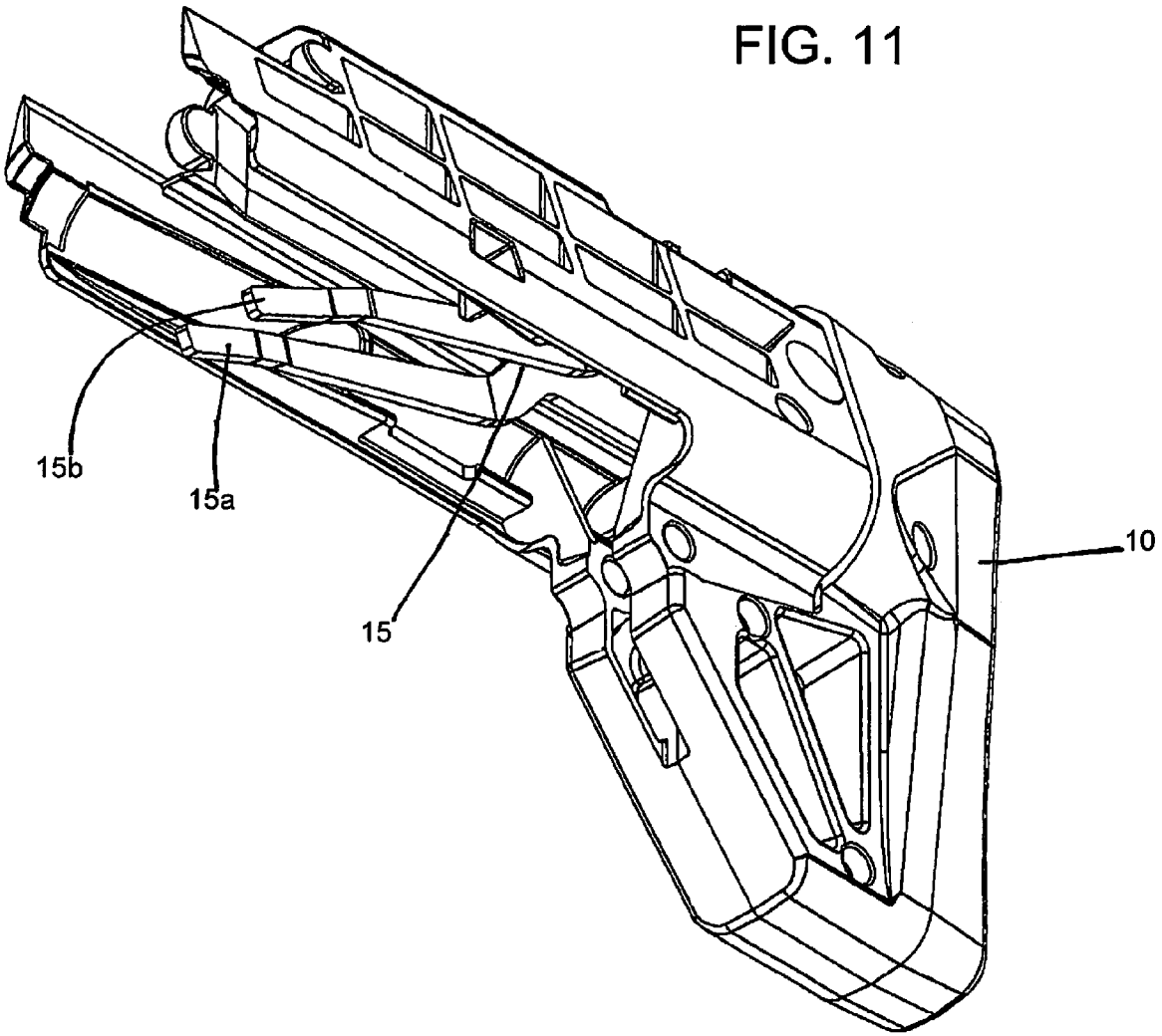
FIG. 11 is a perspective view of the stock showing the lifter that assists in loading shells and aiding in the ejection of spent shells.

FIG. 11 is an enlarged perspective view of the stock 10 with lifter 15 having a right arm 15*a* and a left arm 15*b*. The stock 10 is inserted from the back of the inverted U-shaped sheet metal receiver 40 when the forearm herein is assembled. The stock 10 is sometimes called a hollow stock because it houses moving parts of the lifter 15 with two finger-like protrusions, a right arm 15*a* and a left arm 15*b*. The lifter 15 is a rigid U-shaped steel part that rotates on an axis to lift shells into a position to be fed into the chamber. On the downward rotation, the lifter also serves as the ejector, which aids in expelling the spent shell from the chamber.

In FIG. 11, the stock is shown with reinforcing ribs of a "honeycomb structure" which serve to increase structural rigidity while using less material in the design; other known designs may be used that accomplish the purpose of increasing structural rigidity while reducing the amount of material required for manufacturing the stock.

Disclosed herein is a firearm, such as, a shotgun, with a novel design wherein the parts of the firearm are secured and held in place by an inverted U-shaped stamped sheet metal receiver 40. The novel use of an inverted U-shaped sheet metal receiver 40 with a loading and ejection port 14 cavity is provided thereby advancing the art of firearm manufacture by disclosing a tubular magazine and receiver that is simple to manufacture, lightweight and compact with an increase in ammunition capacity when compared to comparable firearms, such as the Remington® 870.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A firearm, comprising in combination:

a stock including a lifter assembly;

a pistol grip;

an assembly of at least one tubular magazine for ammunition positioned below a barrel with a barrel extension at the rear of the barrel;

a loading and ejection port between the pistol grip and the rear end of the stock, the lifter assembly positioned within the loading a ejection port; and an inverted U-shaped sheet metal receiver between the grip and the stock with an inside cavity for the loading and ejection port, the inverted U-shaped receiver including a front end attachable to a rear end of the grip and a rear end attachable to the stock rear end wherein the inverted U-shaped sheet metal receiver partially encloses, fastens and securely holds the stock, the grip and the assembly of magazine and barrel with barrel extension thereby forming an assembled rear end of a pump action firearm.

2. The firearm of claim 1, wherein the lifter assembly includes:

a U-shaped lifter open at the far end including a left and a right arm lifter that rotates on an axis at the attached rear ends of the left and right arm lifters to lift a shell into a position to be fed into a chamber of a firearm and aid in expelling a spent shell from the chamber, the U-shaped lifter positioned between the grip rear end and the stock front end within the cavity of the inverted U-shaped receiver to form a downward ejection port for the spent shell.

3. The firearm of claim 1, wherein the assembly includes a first tubular magazine and a second tubular magazine positioned below the barrel with the barrel extension at the rear of the barrel.

4. The firearm of claim 1, wherein the barrel has a sight base for mounting a picatinny rail.

5. The firearm of claim 1, wherein the inverted U-shaped sheet metal receiver further includes an attached trunnion for rigidity.

6. The firearm of claim 1, wherein the inverted U-shaped sheet metal receiver is fastened over the forward stock, and the loading and ejection port rearward of the grip and the assembly of magazine and barrel with barrel extension.

7. The firearm of claim 6, wherein the inverted U-shaped sheet metal receiver is integrally formed with a left front rectangular shaped tab and an opposing and matching right front rectangular shaped tab for attaching the trunnion.

8. The firearm of claim 7, wherein the inverted U-shaped sheet metal receiver is integrally formed with a left rear triangular shaped tab and an opposing and matching right rear triangular-shaped tab for attaching the stock and the rear end of the grip, the space between the left and right front tabs and the left and right rear tab forming the loading a ejection port cavity.

9. The firearm of claim 1, wherein the overall length is between approximately 25 inches and approximately 27 inches.

10. The firearm of claim 2 wherein the loading and ejection port assembly further comprise:

a front pin for attaching the loading and ejection port to the rearward pistol grip; and a captor spring that forms an assembly push pin that is inserted into the front pin, an upward rotation of the U-shaped lifter lifts a shell into position to be fed into firing chamber and a downward rotation of the U-shaped lifter aids in expelling a spent shell from the firing chamber.

11. The firearm of claim 8 further comprising:

a front frame pin insertable into a left and right hole in each of the left and right front tabs respectively; and a rear frame pin insertable into a left and right hole in each of the left and right rear tabs respectively, the front and rear frame pins allow rapid assembly and disassembly of the firearm.

12. The firearm of claim 8, wherein the inverted U-shaped sheet metal receiver further includes a trunnion connected between the left and right front rectangular shaped tabs for rigidity, the trunnion with a left side and right side hole aligned for insertion of the front frame pin through the left front tab, the trunnion and the right front tab.

* * * * *